United States Patent [19]

Nagai

[11] 4,188,026

[45] Feb. 12, 1980

[54] PAPER SHEET FEEDING DEVICE

[75] Inventor: Kazumasa Nagai, Hiroshima, Japan

[73] Assignee: Ryobi, Ltd., Hiroshima, Japan

[21] Appl. No.: 872,267

[22] Filed: Jan. 25, 1978

[30] Foreign Application Priority Data

Jan. 31, 1977 [JP] Japan ..... 52/10917[U]

[51] Int. Cl.[2] ..... B65H 7/08

[52] U.S. Cl. ..... 271/148; 271/171

[58] Field of Search ..... 271/148, 171

[56] References Cited

U.S. PATENT DOCUMENTS

| | | | |
|---|---|---|---|
| 2,137,381 | 11/1938 | Blackstone | 271/148 |
| 2,886,314 | 5/1959 | Phelan | 271/148 |
| 3,137,497 | 6/1964 | Good | 271/148 |
| 3,239,219 | 3/1966 | Reeves | 271/148 |

*Primary Examiner*—Richard A. Schacher
*Attorney, Agent, or Firm*—Thomas R. Morrison

[57] ABSTRACT

A feeding attachment for paper sheets of variable small formats is readily attached to and removed from the existing printing machine for printing of smaller format paper sheets or regular printing as desired. The attachment is capable of feeding the paper sheets in an ideal attitude for printing to the printing machine even if each of such sheets has a non-uniform thickness such that, when the sheets are stacked in a pile, each such sheet of the pile will be tilted progressively relative to the horizontal from the bottom towards the top of the pile.

11 Claims, 11 Drawing Figures

PAPER SHEET FEEDING DEVICE

FIELD OF THE INVENTION

This invention relates to a feeding device or attachment that can be readily mounted to the existing printing machine and designed for feeding the paper sheets one by one to the printing machine. The paper sheets handled by the device are generally of small format and may have a uniform or non-uniform thickness.

BACKGROUND OF THE INVENTION

Among the small format printing sheets, a computer card or name card has a uniform thickness such that, when a number of these cards are stacked in a pile, each sheet of the pile will always remain parallel to the horizontal, and can be readily picked up by a plurality of suction cups disposed above the pile. On the other hand, an envelope has a non-uniform thickness, with the flap thereof representing a thicker area as compared to the remaining portion of the envelope. Thus, as a number of envelopes are stacked in a pile, each envelope of the pile will be inclined progressively relative to the horizontal so that the envelopes can no longer be picked up and supplied to the printing machine. Heretofore, wedge-shaped inserts had to be introduced by an operator into a space between the sheet edges at intervals of say fifty sheets for holding the uppermost sheet of the pile in a nearly horizontal position. These inserts had to be removed by the operator as the sheets are continuously fed to the printing machine. This is an extremely tiresome operation and gives rise to increased labor costs.

For example, the U.S. Pat. No. 3,446,500 shows an automatic device designed for offsetting the non-uniform thickness of printed sheets. The device comprises a bottom plate pivotally connected to the hopper and depressed under the weight of the pile which is opposed by the force of resilient means associated with the bottom plate. As the sheets are decreased in the course of the printing operation, the opposing force exerted by such resilient means is gradually reduced for maintaining the upper surface of the pile substantially parallel with respect to the horizontal.

This known device has however a drawback that the spring force may not always be correctly adjusted in advance and hence the horizontal position of the paper sheet can not be attained satisfactorily.

Moreover, in printing paper sheets of a small size or format, a special printing machine had to be employed for printing of small format sheets, and there has been a strong demand for a paper sheet feeding attachment that may be readily attached to and removed from the existing printing machine used for printing of regular size sheets.

These two problems can be solved simultaneously by the feeding device or attachment of the present invention.

SUMMARY OF THE INVENTION

The feeding attachment of the present invention is formed by a guide section and a base or support section. The guide section includes a guide plate that is readily mounted to and dismounted from the printing machine proper and which mounts a pair of upright side guide rails defining a space therebetween for snugly holding the small format sheets. The support section has an auxiliary support plate used for exclusively supporting the small format sheets. The support plate is operatively connected to a drive device mounted to the printing machine through a kinetic chain whereby the angular disposition of the support plate is gradually decreased as the printing operation proceeds.

DESCRIPTION OF THE PREFERRED EMBODIMENT

Figure 1:
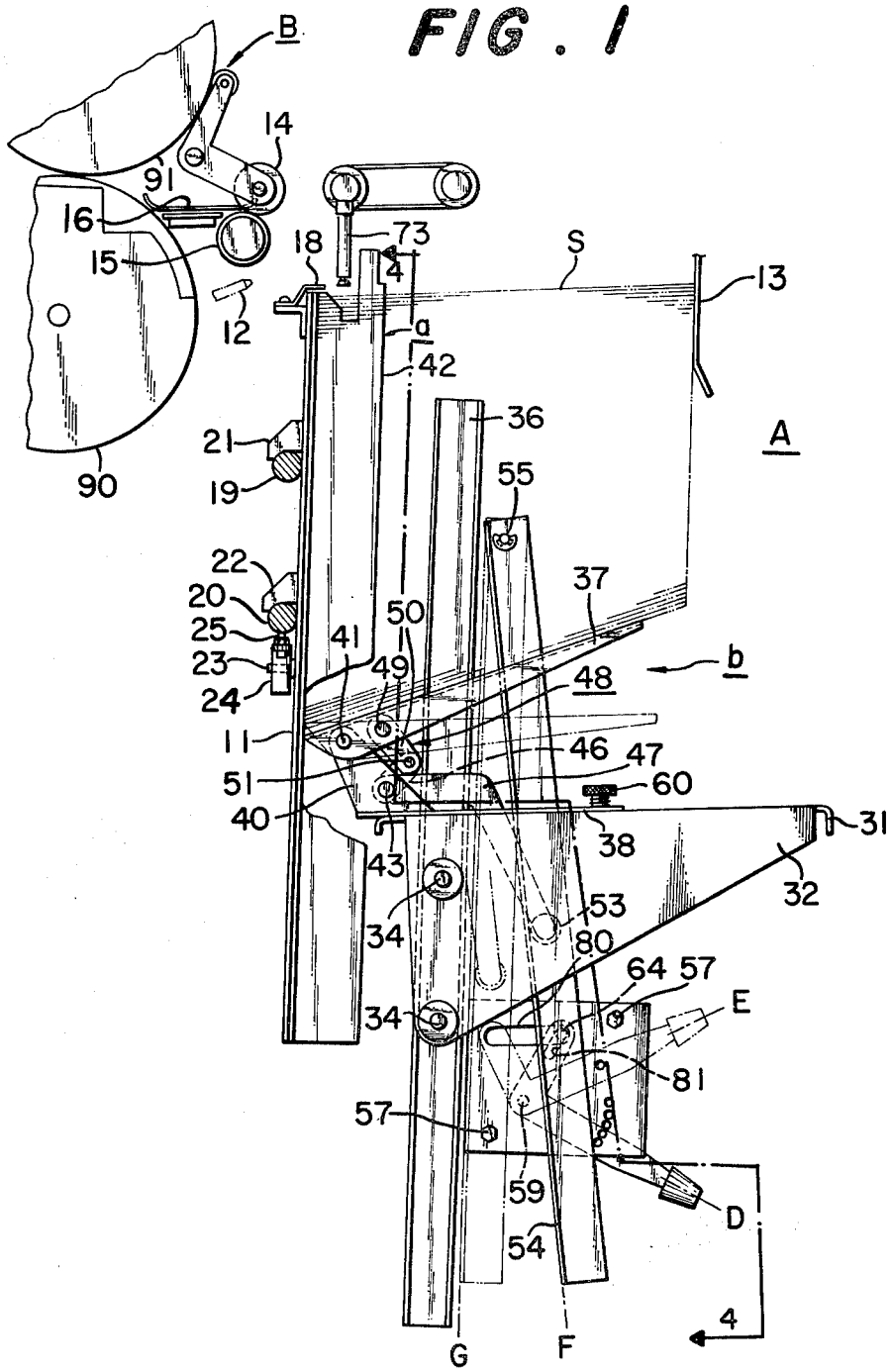
FIG. 1 is a side elevation, shown partly in section and partly with fantom lines, of a preferred embodiment of the inventive feeding attachment.
Figure 2:
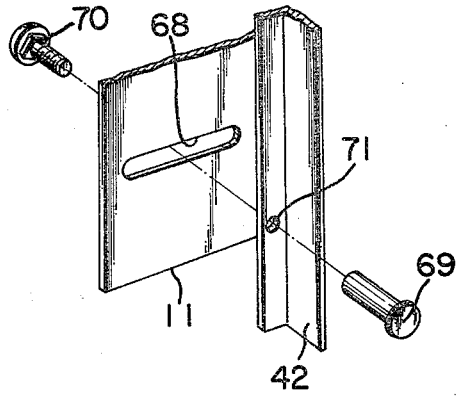
FIG. 2 is a fragmentary view showing the manner in which the side guide rail is mounted to the guide plate.

In FIGS. 1 and 2, there is shown an embodiment of the inventive feeding attachment A mounted to an offset printing machine B, shown only partially for the sake of simplicity. The feeding attachment shown generally at A comprises a guide section a for setting the position of paper sheets S relative to the main portion of the printing machine B and a base section b on which the paper sheets are mounted and automatically elevated in the course of the printing operation.

The guide section a is formed by a guide plate 11 to which the leading edge of each paper sheet S rests in the course of the printing operation. An air blower 12 shown schmatically in FIG. 1 is fixedly mounted near the top of said guide plate 11 for unraveling the edges of several uppermost paper sheets by injection of compressed air as shown schematically in FIG. 3. During this time, the paper sheets S are held at their trailing edges by contact with a back guide plate 13. The paper sheets S are sucked up one by one by a plurality of suction heads 73 pivotally mounted to some stationary portion of the printing machine B above the pile of the paper sheets.

Only one of said suction heads 73 is shown in the side elevation of FIG. 1. The paper sheets S are then gripped by a pair of rotating feed rollers 14, 15 by reason of the vertical and ensuing swinging motion of the suction heads 73 and supplied through a guide 16 towards the nip part between a backup cylinder 91 and an rubber cylinder 90 for transfer printing, in a manner well known in the art.

The air blower 12 is connected to an air hose connected in turn to a pump (not shown) provided to the printing machine B.

The guide plate 11 has a pair of horizontal slots 68 each designed for receiving a female threaded member 69 mating with a male threaded member 70. A pair of side guide plates 42, 42 (FIG. 4) have corresponding through-holes 71 in the flange portions thereof and may be secured to the guide plate 11 in desired positions with an adjustable interval l therebetween by passing the male threaded members 70 through said horizontal slots 68 and said through-holes 71 and tightening the members 69, 70 to each other.

Figure 3:
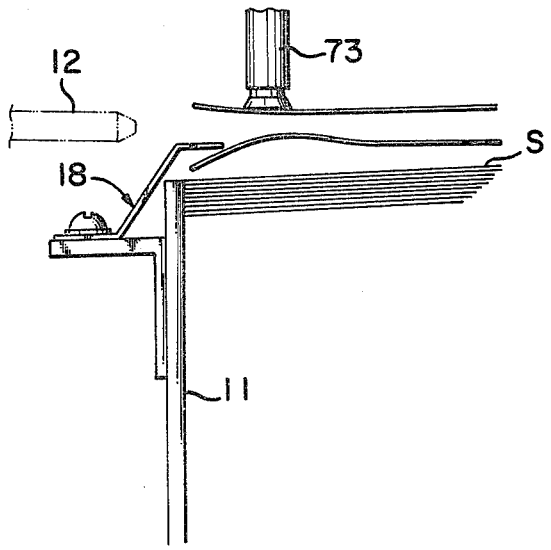
FIG. 3 is a diagrammatic view showing the paper sheets being picked up by a suction cup.

FIG. 3 shows the manner in which the paper sheets are sucked one by one by the suction heads 73 so as to be gripped by the rotating feed rollers 14, 15. As will be apparent from FIG. 3, if two or more sheets are picked up at one time, a resilient metal fixture 18 serves for peeling the sheets except the uppermost sheet and return them to the pile so that only one sheet is supplied to the rotating feed rollers 14, 15 at one time.

The guide plate 11 is integrally formed with a pair of spaced apart projections 21, 22 designed to rest on a pair of correspondingly spaced apart rods 19, 20 secured to some stationary portion of the printing machine B. These projections 21, 22 are placed on the rods 19, 20 when the feeding attachment of the present invention is mounted provisionally to the printing machine.

Figure 4:
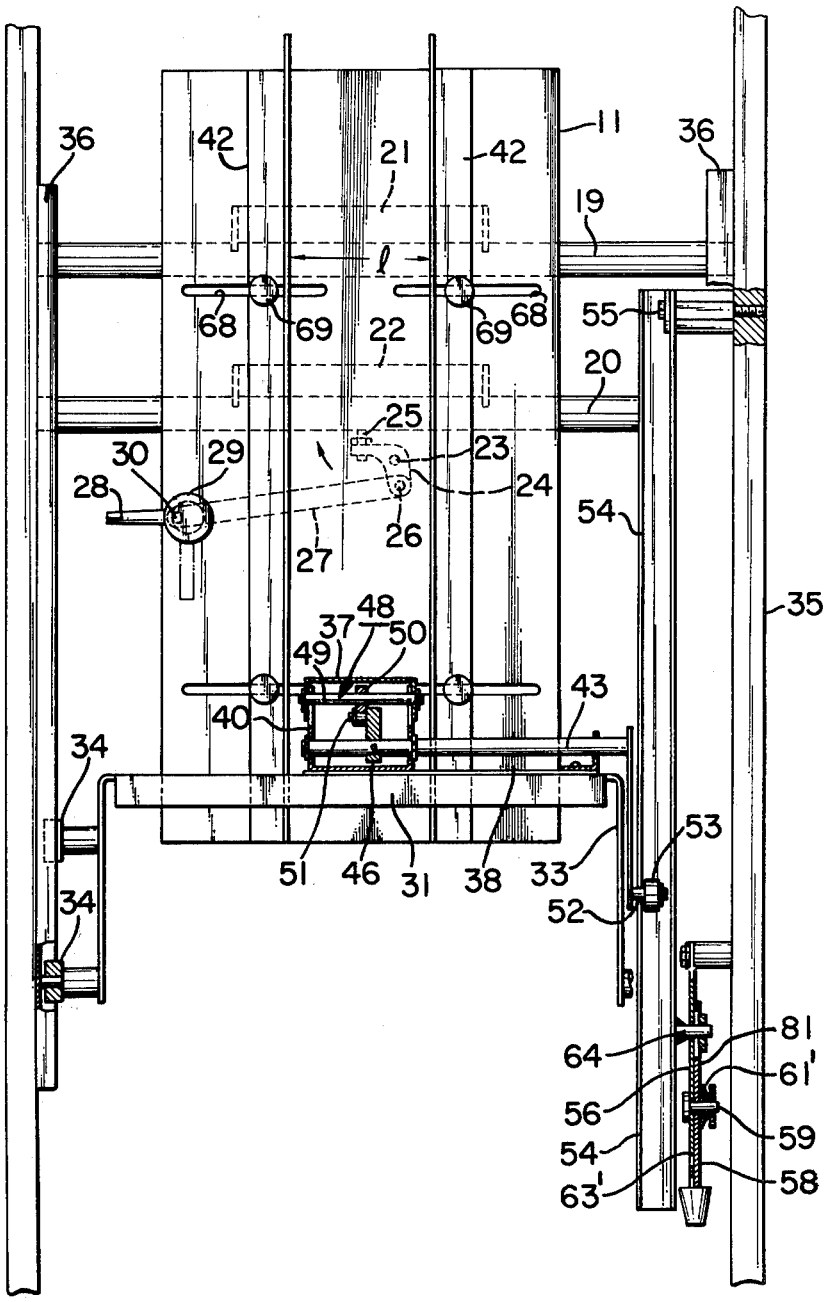
FIG. 4 is a front view of the feeding attachment in partial section taken along 4—4 of FIG. 1.
Figure 6:
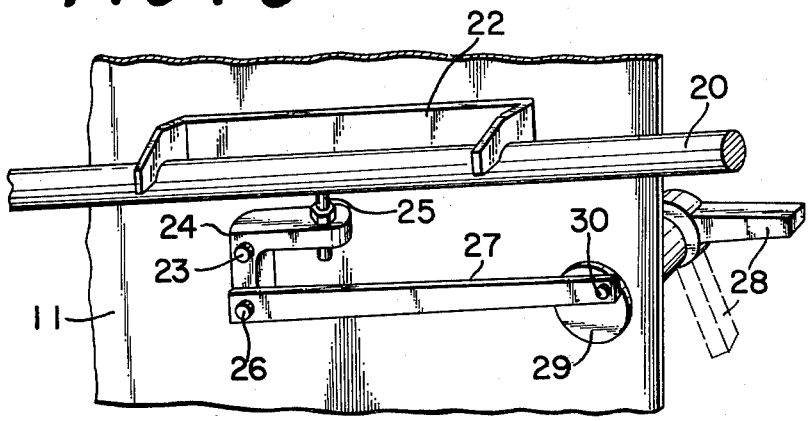
FIG. 6 is a fragmentary back view showing the manner in which the feeding attachment is mounted provisionally to the printing machine.

The feeding attachment is then fastened relative to the printing machine by a hand-operated device shown in FIGS. 4 and 6. The device is formed by a pin 23 secured to the guide plate 11; an L-shaped lever 24 pivotally mounted midway to said pin 23 and having projections 25, 26 at the both ends; a link 27 pivotally mounted at one end to said projection 26, and a hand operated lever 28 integrally formed with a cylindrical boss 29 which is rotatably passed through a through-hole of the guide plate 11. The other end of the link 27 is pivotally mounted to an offset pin 30 secured to or integral with the reverse surface of the cylindrical boss 29 as shown in FIG. 6. When the lever 28 is turned manually from the dashed line position to the full-line position in FIG. 6 that is slightly beyond the upper dead point for the offset pin 30, the link 27 is slightly pulled towards right. Thus, the L-shaped lever 24 is turned counterclockwise about pivot pin 23 for pressing the projection 25 against the underside of the rod 20. The rod 20 may thus be clamped between the projection 25, and the projection 22 for positively securing the feeding attachment A to the printing machine B.

The base section b includes an existing main support plate 31 for paper sheets of larger or regular format. The main support plate 31 is provided on either side with triangular side plates 32, 33 as shown in FIGS. 1 and 4. A pair of guide rolls 34 are rotatably carried by each of said triangular side plates 32, 33 and are guided along vertical guide rails 36, 36 provided to a frame 35 forming a part of the printing machine B. The main support plate 31 is operatively connected to a drive means, not shown, provided in the printing machine B and is designed to travel vertically upwards in the course of printing for offsetting the decrease in height of the pile of paper sheets in a known manner.

Figure 5:
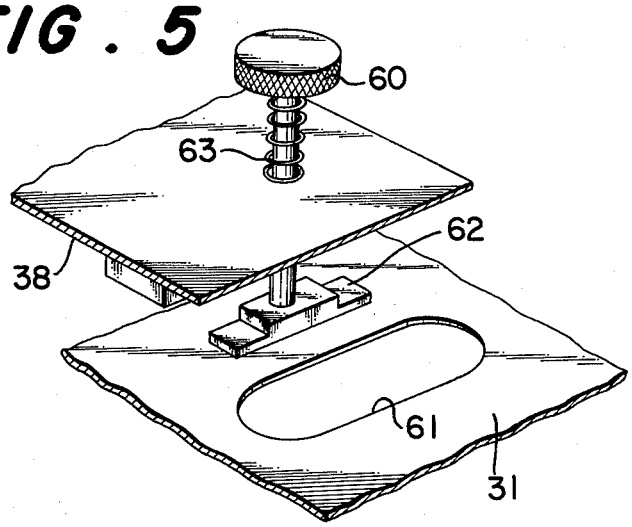
FIG. 5 is a fragmentary view showing the bottom plate attached to the existing main support plate.
Figure 9:
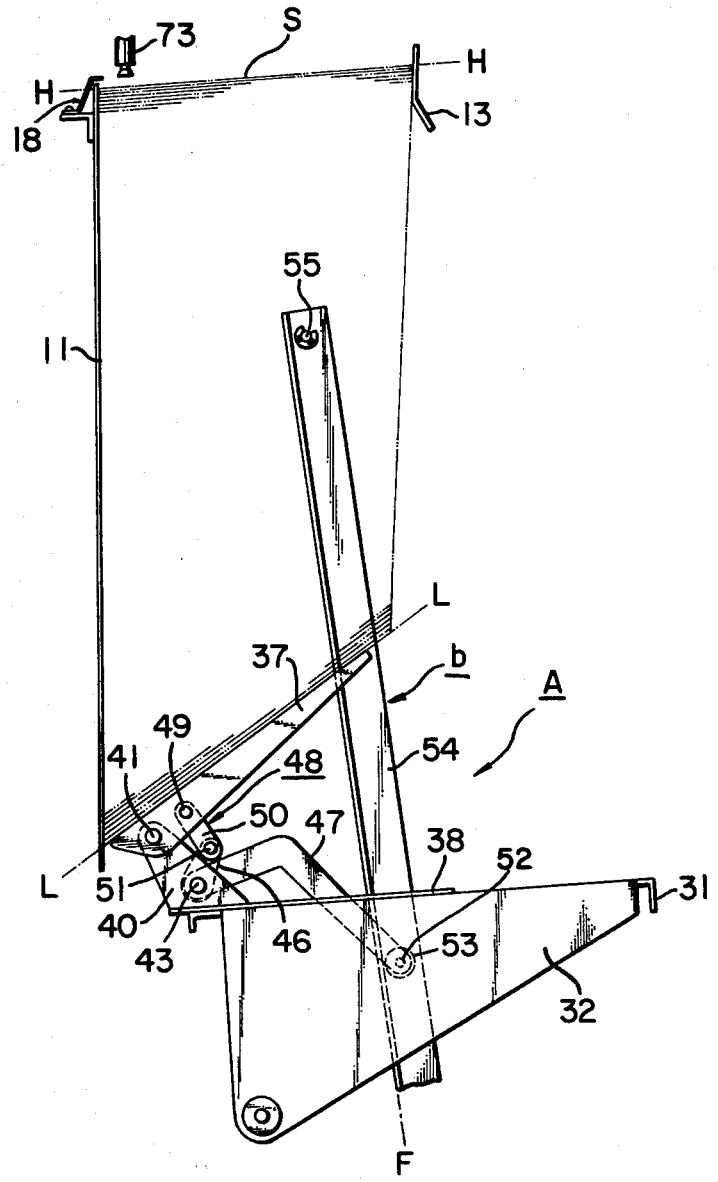
FIGS. 9, 10 and 11 are diagrammatic illustrative views showing the various operating positions of the feeding attachement in the course of the printing operation.

To said main support plate 31 is mounted an auxiliary support plate 37 forming a part of the feeding attachment of the present invention. A bottom plate 38 is removably secured to the upper surface of the main support plate 31 by suitable fastening means which may be a manually operable spring-biased knob 60 as shown in FIG. 5. The spring-biased knob 60 is introduced through an existing elongated slot 61 of the main support plate 31 and may have a fitting 62 at its lower end which may first be introduced through said slot lengthwise thereof. The knob may then be turned by 90° and secured there under the action of a helical spring 63. A pair of brackets 40, 40 are secured to said bottom plate 38 within a space defined on both sides by said side guide plates 42, 42. The auxiliary support plate 37 is pivotally mounted by a transverse shaft 41 to these brackets 40, 40 (FIGS. 1 and 9). The bottom plate 38 thus mounts said auxiliary support plate 37, brackets 40 and other members necessary for swinging the auxiliary support plate 37 as will be described further. The auxiliary support plate 37, thus mounted on said bottom plate 38, may be raised and lowered through the medium of the main support plate 31 within the space defined by said guide plates 42, 42 while being swung with the transverse shaft 41 as center, as will be explained.

Figure 7:
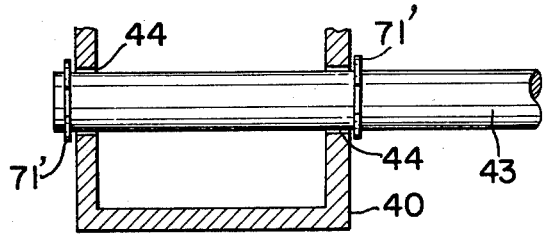
FIG. 7 is a fragmentary cross-sectional view showing certain operative members of the feeding attachment.

As shown in FIG. 7, a drive shaft 43 is freely introduced into openings 44 provided to the brackets 40, 40 for rotation about its own axis and has a pair of peripheral notches or grooves for receiving a pair of elastic ring retainers 71', 71'. These ring retainers serve for preventing accidental removal of the drive shaft 43 from the brackets 40, 40. A slight clearance is provided between the openings 44 and the peripheral surface of the drive shaft 43 to permit free rotation of the drive shaft 43.

Alternatively, the drive shaft 43 may be mounted to the brackets 40, 40 in any desired manner provided that the drive shaft 43 can rotate lightly within the openings 44.

A link 46 and a drive arm 47 are secured to said drive shaft 43 in any desired manner as by glueing, said link 46 forming a member of a link means 48. A shaft 49 is secured to the auxiliary support plate 37 in any known manner as by glueing and carries one end of a link 50 forming the other member of the link means 48. The free end of the link 50 is pivotally carried by a pin 51 in turn secured to the link 46 as by glueing. In this way, the auxiliary support plate 37 is operatively connected to said drive arm 47 by way of said link means 48 and said drive shaft 43.

The free-end of the L-shaped drive arm 47 carries a pin 52 which carries in turn an end roller 53. A roller guide rail 54 is mounted pivotally at the top to a pivot shaft 55 bolted to the upper portion of the frame 35.

Figure 8:
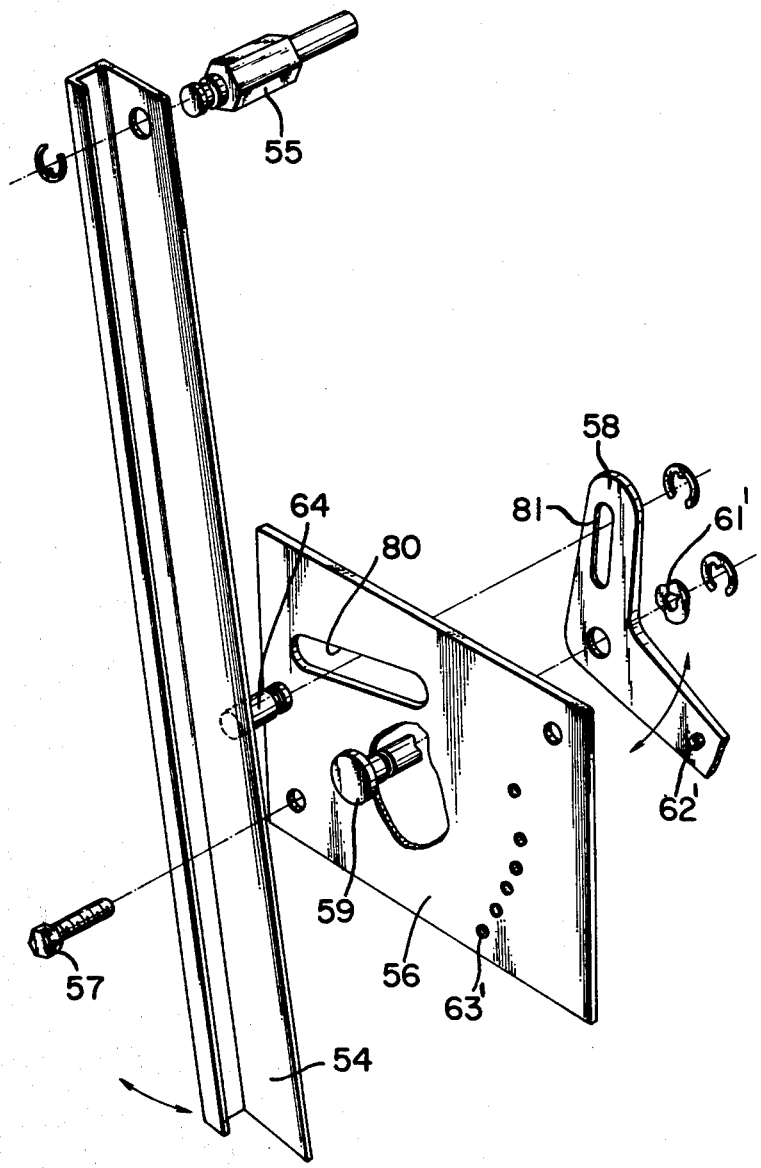
FIG. 8 is an exploded view showing the lower right portion of FIG. 4.

Referring to FIGS. 4 and 8, a mounting plate 56 is secured as with mounting screws 57 to a portion of the frame 35 corresponding to the lower end of the pendulously support roller guide rail 54. An operating angle lever 58 is pivotally mounted at the bent portion by a pin 59 to the mounting plate 56.

The pin 59 is passed through registering holes formed in the mounting plate 56 and the operating angle lever 58 and secured to the back surface of the mounting plate 56 as by riveting. A resilient corrugated washer 61' is placed between an elastic retaining fitted to an annular groove, not shown, on the free end of the pin 59 and the front surface of the operating angle lever 58 so that the mounting plate 56 and operating angle lever 58 are resiliently pressed to each other when the pin 59 is riveted to the mounting plate 56.

The operating angle lever 58 is formed with a positioning boss 62' near the grip end for setting the operating angle lever 58 at the desired angular position. To this end, the mounting plate 56 has a plurality of positioning holes 63' at predetermined intervals from one another, each said positioning hole 63' being designed to snugly receive the positioning boss 62'. These positioning holes 63' are formed along an arcuate line corresponding to the path of travel of the positioning boss 62'. As the positioning boss 62' is received in one of these positioning holes 63', the operating angle lever 58 is resiliently pressed onto the mounting plate 56 under the urging force exerted by the corrugated washer 61'.

The roller guide rail 54 has a projection 64 (see FIG. 8) secured as by glueing or riveting to the front surface of the roller guide rail 54, said projection extending towards the frame 35 and passing through an elongated slot 81 in the operating angle lever 58 and an elongated horizontal slot 80 in the mounting plate 56. As the operating angle lever 58 is set to the desired tilting position at the start of printing operation, the projection 64 is guided within the elongated slot 81 in the operating angle lever 58 and the elongated horizontal slot 80 in the mounting plate 56 so that the roller guide rail 54 is moved left and right in FIG. 1 depending on the movement given to the operating angle lever 58.

In operation, the feeding attachment A is mounted to the printing machine B in case of printing small size paper sheets. The side guide plates 42, 42 are fixed in position with an interval l therebetween in registry with the width of the paper sheets S. The paper sheets are placed into a pile on the auxiliary support plate 37.

Figure 10:
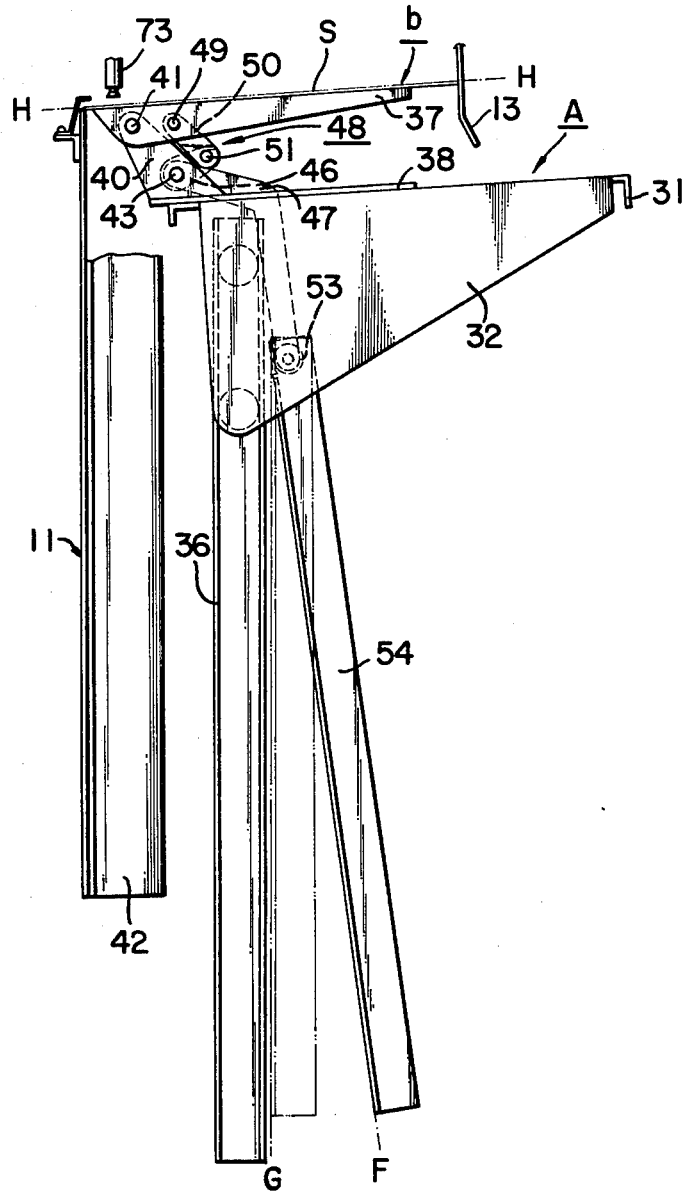
Figure 11:
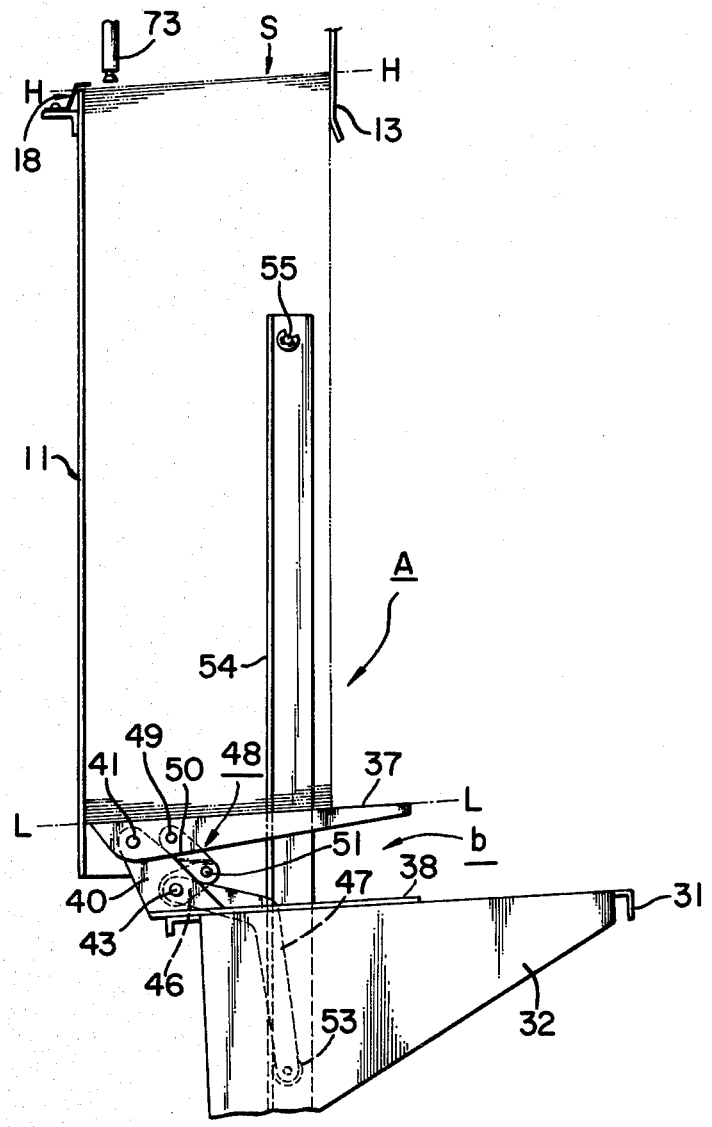

FIG. 9 illustrates a number of paper sheets, such as envelopes, said sheet having a non-uniform thickness. These paper sheets are supported in the orderly manner on the auxiliary support plate 37. In FIG. 10, almost all of the envelopes have been fed to the printing machine from the state shown in FIG. 3 and only several sheets are shown resting on the auxiliary support plate 37. On the other hand, FIG. 11 shows a pile of paper sheets resting on the auxiliary support plate 37, the sheets each having a uniform thickness, such as postcards or name cards.

For feeding paper sheets, such as envelopes, each of which has a zone of increased thickness at the flap as compared with the remaining portions, the operating angle lever 58 is shifted to a full-line position D in FIG. 1, and the positioning boss 62' engages with the positioning hole 63' situated at this position. The roller guide rail 54 is thereby swung to the position F in FIG. 1 with the pivot shaft 55 as center and provisionally secured in such position.

The end roller 53 then slides on the surface of a lateral flange of the roller guide rail 54 and is thus urged to travel towards upper right in FIG. 1 for turning the L-shaped drive arm 47 counterclockwise about the drive shaft 43. This causes the drive shaft 43 to rotate about its own axis so that the link means 48 tends to be straightened with the pin 51 moving towards left in FIG. 1. The auxiliary support plate 37 is forced to swing counterclockwise about shaft 41 under the urging pressure exerted by the link 50 and hence will assume an inclined support position for the pile of paper sheets, depending on the initial setting of the operating angle lever 58.

When the pile of sheets S has the maximum height before the start of the feeding operation, the auxiliary support plate 37 will have a maximum angle relative to the horizontal, as shown by a dashed line L-L in FIG. 9. The upper surface of the pile is then in a substantially horizontal position as shown by a dashed line H-H in FIG. 9, on account of the above-mentioned manual setting of the operating angle lever 58.

As the feeding and printing of the paper sheets S is started, the main support plate 31 is driven upwards by a drive means that is in gear with the driving device, not shown, of the printing machine B. Upon completion of feeding, the support surface of the auxiliary support plate 37 is set to be substantially parallel to that of the main support plate 31, as shown in FIG. 10.

Thus, as the main support plate 31 is raised from the position of FIG. 9 to that of FIG. 10, the plane L-L defined by the upper surface of the auxiliary support plate 37 will gradually approach the horizontal.

To this end, the linkage or kinetic chain comprising the auxiliary support plate 37, link means 48, brackets 40, 40 and the L-shaped drive arm 47 should be so designed that the auxiliary support plate 37 will assume its horizontal or substantially horizontal position when the roller guide rail 54 engaging with the end roller 53 of the L-shaped drive arm 47 is brought to a vertical position parallel to the vertical guide rails 36, 36.

Moreover, the pivot shaft 55 for the roller guide rail 54 should be so situated relative to the kinetic chain that the end roller 53 will have travelled to the upper end of the roller guide rail 54 and is about to contact the pivot shaft 55 when the auxiliary support plate 37 has reached its uppermost position shown in FIG. 10. In addition, once the position of the pivot shaft 55 is thus fixed, the lengths of the slots 80, 81 and hence the angular shape of the operating angle lever 58 will be determined from the design point of view in consideration of the maximum possible variation in the lengthwise thickness of the paper sheets S that may be handled by the feeding attachment.

The angular position of the auxiliary support plate 37 is adjusted by positioning the positioning boss 62' in the selected positioning hole 63' in consideration of the degree of non-uniformity in thickness of the envelope S that is being printed and the number of the envelopes included in the pile. In this way, the upper surface of the uppermost envelope may be kept in a horizontal or nearly horizontal position suitable for consecutive printing.

When the sheet S has an overall uniform thickness, there is no necessity for changing the angular setting of the auxiliary support plate 37. In this case, the operating angle lever 58 is set to a position E in FIG. 1 thus causing the rail 54 to swing clockwise about pivot shaft 55 to a position G in which the roller guide rail 54 extends vertically from the pivot shaft 55 in parallel with the vertical guide rails 36. The rail 54 can be secured in this position by engagement of the positioning boss 62' with the positioning hole 63'.

The end roller 53 can then travel along a vertical path up to a position to nearly contact with the pivot shaft 55 from the lowermost position shown by the dotted line in FIG. 1. Therefore, the upper surface of the auxiliary support plate 37 is kept parallel to that of the main support plate 31 in the course of vertical travel from its lowermost position to its uppermost position.

While the present invention has been described by referring to the specific embodiment shown in the accompanying drawings, it is to be understood that the invention is not limited to such illustrative embodiment, but various changes can be made within the scope of the invention defined by the appended claims.

The Embodiments of the invention in which an exclusive property or privilege is claimed are defined as follows:

1. A feeding attachment for a printing machine of the type having a vertically travelling support plate for supporting a pile of paper and for maintaining the top sheet in the pile of paper at a substantially constant level for feeding said top sheet into said printing machine, wherein the improvement comprises:

(a) an auxiliary support plate removably pivotably connected to said vertically travelling support plate and moving in the vertical direction therewith for supporting said pile of paper;

(b) pivot means for pivoting said auxiliary support plate with respect to said vertically travelling support plate;

(c) actuating means for controlling the angle of said auxiliary support plate with respect to said vertically travelling support plate;

(d) said actuating means having a guide rail;

(e) pivoting means for adjusting an angle between an axis of travel of said vertically travelling support plate and an axis of said guide rail;

(f) lever means connected to said auxiliary support plate for controlling the pivoting thereof; and (g) engagement means on said lever means engaging said guide rail and being operative to pivot said auxiliary support plate in proportion to the vertical position of said vertically travelling support plate.

2. The feeding attachment recited in claim 1 further comprising manual setting means for setting the relationship between said angle and said vertical position.

3. The feeding attachment recited in claim 1 further comprising:

(a) auxiliary guide means for vertically guiding the lateral edges of said sheets;

(b) said auxiliary guide means having means for temporary attachment to said printing machine; and (c) two adjustable side guide plates on said auxiliary guide means, the spacing between said side guide plates being variable to accommodate different width sheets.

4. The feeding attachment recited in claim 1 further comprising:

(a) said guide rail being pivotably attached at its upper end to said printing machine; and (b) manual means for adjustably fixing the lower end of said guide rail.

5. A feeding attachment for a printing machine of the type having a pair of fixed vertical guide rails, a horizontal support plate vertically moveable guided by said fixed guide rails, means for supporting a pile of sheets and moving the pile upward as the top sheet is fed into the printing machine whereby the top sheet of the pile is maintained at a substantially fixed level, wherein the improvement comprises:

(a) said means for supporting being a removable auxiliary support plate for supporting said pile of sheets pivotably attached to said horizontal support plate and disposed to move vertically therewith;

(b) a pivotable guide rail having first and second ends pivoted at its first end to said printing machine;

(c) manually adjustable means for fixing the second end of said pivotable guide rail;

(d) said manually adjustable means being operative to fix said second end in at least first and second positions, said first position placing said pivotable guide rail substantially parallel to said fixed guide rail and said second position placing said pivotable guide rail at an angle inclined to said fixed guide rail;

(e) a drive arm having a first end pivotably fixed to said horizontal support plate and a second end guidedly contacting said pivotable guide rail; and (f) linkage means for pivoting said auxiliary support plate in proportion to the distance between the point of contact of the second end of said drive arm with said pivotable guide rail and said fixed guide rail.

6. The feeding attachment recited in claim 5 wherein said linkage means comprises:

(a) a drive shaft having first and second ends affixed at its first end to the second end of said drive arm and pivoted to said horizontal support plate;

(b) a first link having first and second ends fixed at its first end to said drive shaft;

(c) a second link having first and second ends pivotably attached at its first end to the second end of said first link;

(d) said second link being pivotably attached at its second end to said auxiliary support plate; and (e) the point of pivotable attachment between said second link and said auxiliary support plate being displaced from the point of pivotable attachment of said auxiliary support plate to said horizontal support plate whereby movement of said second link rotates said auxiliary support plate about its pivotable attachment to said horizontal support plate.

7. The feeding attachment recited in claim 5 wherein said auxiliary support plate is removeably attached to said horizontal support plate.

8. A feeding attachment for a printing machine of the type having a pair of fixed vertical guide rails, a horizontal support plate vertically moveable guided by said fixed guide rails, means for supporting a pile of sheets and moving the pile upward as the top sheet is fed into the printing machine whereby the top sheet of the pile is maintained at a substantially fixed level, wherein the improvement comprises:

(a) said means for supporting being an auxiliary support plate pivotably attached to said horizontal support plate and disposed to move vertically therewith;

(b) a pivotable guide rail having first and second ends pivoted at its first end to said printing machine;

(c) manually adjustable means for fixing the second end of said pivotable guide rail;

(d) said manually adjustable means being operative to fix said second end in at least first and second positions, said first position placing said pivotable guide rail substantially parallel to said fixed guide rail and said second position placing said pivotable guide rail at an angle inclined to said fixed guide rail;

(e) a drive arm having a first end pivotably fixed to said horizontal support plate and a second end guidedly contacting said pivotable guide rail;

(f) linkage means for pivoting said auxiliary support plate in proportion to the distance between the point of contact of the second end of said drive arm with said pivotable guide rail and said fixed guide rail;

(g) said manually adjustable means including an L-shaped lever pivoted at the junction of the arms of the L to said printing machine;

(h) one leg of said L-shaped lever forming a handle for manual actuation thereof;

(i) a plate having at least two spaced-apart holes therein, said plate being disposed adjacent said L-shaped lever;

(j) a boss on said L-shaped lever, said boss and said at least two spaced-apart holes being disposed such that said boss may be fitted into any of said at least two spaced-apart holes to fix the position of said L-shaped lever about its pivot;

(k) a slot in the second leg of said L-shaped lever parallel to the axis thereof; and (l) a member attached to said pivotable guide rail passing through said slot.

9. A feeding attachment for feeding sheets to a printing machine, said attachment comprising:

(a) an auxiliary support plate for supporting a pile of sheets, said auxiliary support plate being operatively associated with a support plate that is driven into a vertical movement in timing with the printing operation performed by said printing machine;

(b) a guide rail means pivotably supported from said printing machine;

(c) a linkage interconnecting said auxiliary support plate with said guide rail means for pivoting said auxiliary support plate in proportion to its vertical position; and (d) manually operable means for adjusting the guide rail means whereby the amount of pivoting of said auxiliary support plate is adjusted.

10. A feeding attachment for feeding sheets to a printing machine, each said sheet being of nonuniform thickness from one area thereof to the other so that, when said sheets are stacked into a pile, the upper surface of the latter will be inclined at an angle with the lower surface thereof, said attachment comprising:

(a) an auxiliary support plate for supporting said pile;

(b) a main support plate that is driven into a vertical movement in timing with the printing operation performed by said printing machine;

(c) said main support plate and said auxiliary support plate being pivotably connected together;

(d) means for progressively pivoting said auxiliary support plate with respect to said main support plate in proportion to the vertical position thereof; and (e) manually operable means for initially setting said means for progressively pivoting whereby the angular disposition of said auxiliary support plate is established to accommodate the inclination of the upper and lower surfaces of said sheets at substantially all thicknesses of said pile.

11. A feeding attachment for a printing machine of the type having a pair of fixed vertical rails comprising:

a pivotable guide rail having first and second ends and pivoted at said first end to said printing machine;

a horizontal support plate vertically movable guided by said fixed guide rails, means for supporting a pile of sheets and moving the pile upward as the top sheet is fed into the printing machine;

a drive arm having a first end pivotably fixed to said horizontal support plate and a second end guidedly connecting said pivotable guide rail whereby the top sheet of the pile is maintained at a substantially fixed level;

said means for supporting being an auxiliary support plate pivotably attached to said horizontal support plate and disposed to move vertically therewith;

pivot and linkage means for pivoting said auxiliary support plate in proportion to the distance between the point of contact of the second end of said drive arm with said pivotable guide rail and said fixed guide rail;

manually adjustable means for fixing the second end of said pivotable guide rail in at least first and second positions, said first position placing said pivotable guide rail substantially parallel to said fixed guide rail and said second position placing said pivotable guide rail at an angle inclined to said fixed guide rail;

said manually adjustable means including an L-shaped lever pivoted at the junction of the arms of the L to said printing machine;

one leg of said L-shaped lever forming a handle for manual actuation thereof;

a plate having at least two spaced-apart holes therein, said plate being disposed adjacent said L-shaped lever;

a boss on said L-shaped lever, said boss and said at least two spaced-apart holes being disposed such that said boss may be fitted into any of said at least two spaced-apart holes to fix the position of said L-shaped lever about its pivot;

a slot in the second leg of said L-shaped lever parallel to the axis thereof; and a member attached to said pivotable guide rail passing through said slot.

* * * * *